US006677397B1

(12) United States Patent
Baranowski et al.

(10) Patent No.: US 6,677,397 B1
(45) Date of Patent: Jan. 13, 2004

(54) CLOSURE CAP LINERS HAVING OXYGEN BARRIER PROPERTIES

(75) Inventors: Thomas R. Baranowski, Chicago, IL (US); Richard W. Cormack, Naperville, IL (US); James Taber, Aurora, IL (US)

(73) Assignee: White Cap, Inc., Downers Grove, IL (US)

( * ) Notice: Subject to any disclaimer, the term of this patent is extended or adjusted under 35 U.S.C. 154(b) by 0 days.

(21) Appl. No.: 09/638,240

(22) Filed: Aug. 14, 2000

(51) Int. Cl.[7] ..... C08K 5/01; C08L 91/08
(52) U.S. Cl. ..... 524/488; 525/191; 525/240
(58) Field of Search ..... 428/35.7; 524/488; 525/191, 240

(56) References Cited

U.S. PATENT DOCUMENTS

| | | | | |
|---|---|---|---|---|
| 2,194,958 | A | 3/1940 | Szegvari et al. | 260/759 |
| 2,557,169 | A | 6/1951 | Benner | 260/8 |
| 3,897,260 | A | 7/1975 | Yaginuma et al. | 260/669 P |
| 3,924,051 | A | 12/1975 | Wiggins et al. | 428/520 |
| 4,151,924 | A | 5/1979 | Jameson | 215/347 |
| 4,198,369 | A | 4/1980 | Yoshikawa et al. | 264/268 |
| 4,235,953 | A | 11/1980 | Kumins et al. | 428/332 |
| 4,360,120 | A | 11/1982 | Samuel et al. | 524/494 |
| 4,468,254 | A | 8/1984 | Yokoyama et al. | 106/271 |
| 4,684,554 | A | 8/1987 | Ou-Yang | 428/35 |
| 5,018,632 | A | 5/1991 | Schmidt | 215/230 |
| 5,060,818 | A | 10/1991 | Doi et al. | 220/454 |
| 5,143,763 | A | 9/1992 | Yamada et al. | 428/36.2 |
| 5,289,932 | A | 3/1994 | Dimeo et al. | 215/349 |
| 5,296,129 | A | 3/1994 | Ikeda et al. | 207/20 |
| 5,381,914 | A | 1/1995 | Koyama et al. | 215/341 |
| 5,685,443 | A | 11/1997 | Taber et al. | 215/252 |
| 5,772,076 | A | 6/1998 | Juk et al. | 222/153.06 |
| 5,843,577 | A | 12/1998 | Ouhadi et al. | 428/474.7 |
| 5,849,418 | A | 12/1998 | Hoenig et al. | 428/500 |
| 5,855,836 | A | 1/1999 | Leyden et al. | 264/401 |
| 5,955,163 | A | 9/1999 | White | 428/35.7 |
| 6,140,418 | A * | 10/2000 | Yamashita et al. | 525/88 |

* cited by examiner

*Primary Examiner*—Sandra M. Nolan
(74) *Attorney, Agent, or Firm*—Cook, Alex, McFarron, Manzo, Cummings & Mehler, Ltd.

(57) ABSTRACT

Liners with improved oxygen barrier properties for use with closure caps are disclosed. The liners are made of a composition that includes a thermoplastic elastomer, polyisobutylene and polybutylene. The liner is adhered to the inner facing surface of a closure cap.

13 Claims, 2 Drawing Sheets

CLOSURE CAP LINERS HAVING OXYGEN BARRIER PROPERTIES

The present invention generally relates to improved oxygen barrier liner compositions for plastic closures and more particularly, to homogeneous thermoplastic elastomer liner compositions which provide an effective barrier to oxygen ingress into the containers and which are advantageously characterized by improved physical properties such as increased tensile strength and elongation. This invention also relates to a method for making such liners from such plastic compositions and to closures for containers for food and beverage products which closures include these liner compositions.

BACKGROUND OF THE INVENTION

Closures for use in food and beverage containers include a closure shell formed of metal, plastic or both metal and plastic and are typically provided with a liner on the inner surface of the closure shell end panel. The liner is intended to provide a hermetic seal between the closure member and the container opening.

Notwithstanding the lined closure, oxygen can permeate the closure shell or enter through spaces between the closure shell and the container. Oxygen can adversely affect beverage and food products stored within a container since a small amount of oxygen can alter the taste of the beverage or food product or cause spoilage of the product. Accordingly, it is desirable that the liners be made of or include a material that is a barrier to oxygen. Efforts to provide a liner that is an effective barrier against oxidation of the food or beverage stored within a container are described in the prior art.

U.S. Pat. No. 5,955,163 to White discloses a gasket for closures used with beverage containers. The gasket is formed of a thermoplastic material which includes, for example, a hydrogenated copolymer of styrene and conjugated diene or functionalized derivative thereof and a rubbery polymer such as butyl rubber which, according to this patent, further prevents ingress of oxygen and volatile odors. The gasket is used with metal crown caps.

U.S. Pat. No. 4,684,554 to Ou-Yang describes a multi-layered seal that includes a pulpboard backing, a wax coating over the pulpboard, aluminum foil and a heat-sealable polymeric coating over the foil. The aluminum foil acts as an oxygen barrier. The multi-layered seal is mounted inside the closure of a container. The container and the closure (with the seal) is treated in a radio frequency field, such that when the closure is removed from the container, the pulpboard backing twists free from the foil which remains bonded to the lip of the container. The foil is then peeled off the lip of the container when access to the contents is desired. While aluminum foil provides a good barrier to oxygen, from the standpoint of a consumer, such peelable seals are less than desirable because of the difficulty often encountered in removing them from the opening of the container.

Another example of a closure with an oxygen absorbing liner is described in U.S. Pat. No. 5,381,914 to Koyama et al. The liner described therein is made of a resin which is blended with an oxygen absorbing agent. The composition can be applied to the entire inner surface of the closure shell or, more typically, may be incorporated as a layer of a laminated structure. The laminate includes the layer of the oxygen absorbing agent and a layer of resin interposed between the oxygen absorbing layer and the closure shell. The oxygen absorbing layer can be made of a thermoplastic elastomer with the oxygen absorbing agent blended therein. Examples of suitable organic oxygen absorbing agents include phenol-type resins, ascorbic acids, saccharides and the like.

U.S. Pat. No. 5,143,763 to Yamada et al. describes a multi-layered seal for use with bottle closures that include a layer of an oxygen absorbent composition and an oxygen permeable film covering the oxygen absorbent composition. The composition includes an asymmetric porous membrane where the outer surface is formed as a dense skin layer. The dense skin layer protects the oxygen absorbent layer from being contacted by the food or beverage stored within the container.

While the liners or seals described above may be effective in limiting the amount of oxygen ingress into the container, further improvements in the field of oxygen barrier liners for closures are desirable.

For example, it would be desirable to provide a liner which acts as an oxygen barrier and can be used in association with resealable plastic closures. It would also be desirable that such liners not require peeling or removal by the consumer.

In addition to providing a barrier to oxygen, liners for use in food or beverage container closures should possess other properties. For example, the liner and the plastic compositions used for such liners must possess good to excellent adhesion to the inner surface of the closure preferably without the use of a separate adhesive.

Also, the sealing provided by the liner should not be such that it is difficult for the average user to open the container. Accordingly, the liner must have good "torque removal" properties to allow for easy removal (e.g., by unscrewing) of the cap without having to use excess force.

The liner should also be made of a composition that is easy to process. Oil-based plasticizers, such as mineral oil, have been included in liner compositions to improve the processability of the composition. However, under certain conditions, extractable compounds from the mineral oil have been known to migrate from the liner composition to the stored food product. Plasticizers such as mineral oil have also been known to exhibit an odor and/or affect the taste of the food product. Thus, it would be desirable to provide a liner that is easy to process but (1) does not include an oil or other plasticizer, (2) does not affect the taste of the stored food product, and (3) is substantially odorless.

It would also be desirable to provide a liner that can be easily formed into flat liners by known techniques such as injection molding and cold punch molding, and that can otherwise be easily incorporated into the closure.

The plastic composition of the present invention and liners made from such plastic compositions address at least all of the above-described objectives. For example, our studies have shown that the preferred single layer liner in accordance with the present invention has an oxygen ingress rate of between approximately 4–8 cc/m$^2$/day, a 100% modulus greater than approximately 260 psi, % elongation of greater than approximately 350 and a tensile strength (psi) greater than approximately 500. Also, we have observed that the desirable properties described above can be affected by the relative proportions of the compounds used in the liner composition. For example, excess polybutylene will negatively affect the sealability of the liners in relation to the container opening, whereas too little polybutylene can reduce the adhesion of the liner to the inner surface of the closure cap. An amount of polyisobutylene that is significantly lower than the amount used in the composition of the present invention will reduce the oxygen barrier properties, while too much polyisobutylene can make the composition more difficult to process.

SUMMARY OF THE INVENTION

There are several different aspects to the present invention. In one aspect, the present invention is directed to a closure cap liner or gasket composition comprising a blend of a thermoplastic elastomer, polybutylene and polyisobutylene. In another aspect of the present invention, the plastic composition can also advantageously include a microcrystalline wax.

Plastic compositions of the type described above exhibit excellent oxygen barrier properties and, therefore, are useful in closures for food or beverage containers. Accordingly, in another aspect, the present invention is directed to a container closure comprising a plastic shell having an end panel and an integral skirt that extends downwardly from the periphery of the skirt. The end panel has an inner-facing surface and includes a substantially oxygen impermeant liner which is adhered to at least a portion of the inner-facing surface. The liner is made from a material including a thermoplastic elastomer, polybutylene and polyisobutylene. In another aspect of the present invention, the liner can also advantageously contain a microcrystalline wax.

The present invention is also directed to a method for providing a liner for a container closure. The method includes (1) combining and mixing polyisobutylene with a thermoplastic elastomer, (2) adding polybutylene to the mixture of polyisobutylene and thermoplastic elastomer to provide a blend, and (3) forming the blend into a liner. A microcrystalline wax can be advantageously added to the blend of thermoplastic elastomer, polybutylene and polyisobutylene. The liner can be formed into a disc or a ring adhered to the inner-facing surface of the closure.

The objects of this invention are achieved with closure caps that include liners made from a composition that comprises a thermoplastic elastomer, polyisobutylene and polybutylene.

DETAILED DESCRIPTION OF THE DRAWINGS

DETAILED DESCRIPTION OF THE INVENTION

The plastic composition of the present invention will be described below in the context of its preferred use, namely, as a liner for a plastic closure of a food or beverage container. It will be appreciated, however, that the plastic composition of the present invention is not limited to such use. The plastic composition of the present invention can be used in any other application where, for example, a material with oxygen barrier properties is desired, and/or where a material exhibiting excellent adhesion to a plastic substrate is desired.

Figure 1:
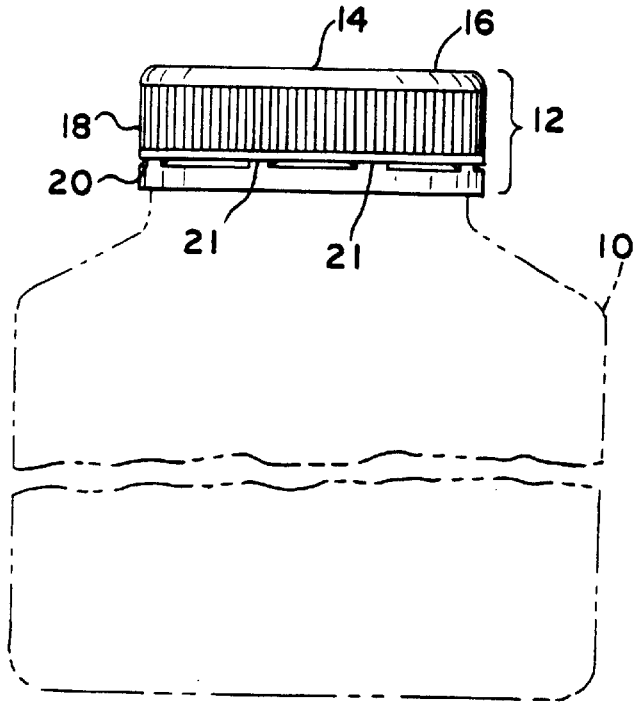
FIG. 1 is a side view of a plastic closure of the type used in connection with the present invention.

Turning now to the drawings, FIG. 1 shows a container 10 with a closure 12 secured over the open mouth of the container. Closure 12 includes a shell generally designated by the reference numeral 14. Shell 14 includes an end panel 16 and a skirt 18. In the illustrated embodiment closure 12 further includes a tamper-evident band 20 integrally formed with and secured to the base of the skirt by a plurality of frangible bridges 21. Closure 12 can typically be made by, for example, injection molding from a thermoplastic composition such as, for example, a polyolefin such as polypropylene. Closure 12 can be made of polyethylene or a blend of polyethylene and polypropylene. Alternatively, closure 12 can be made of a plastic/metal composite material or entirely of metal.

Figure 2:
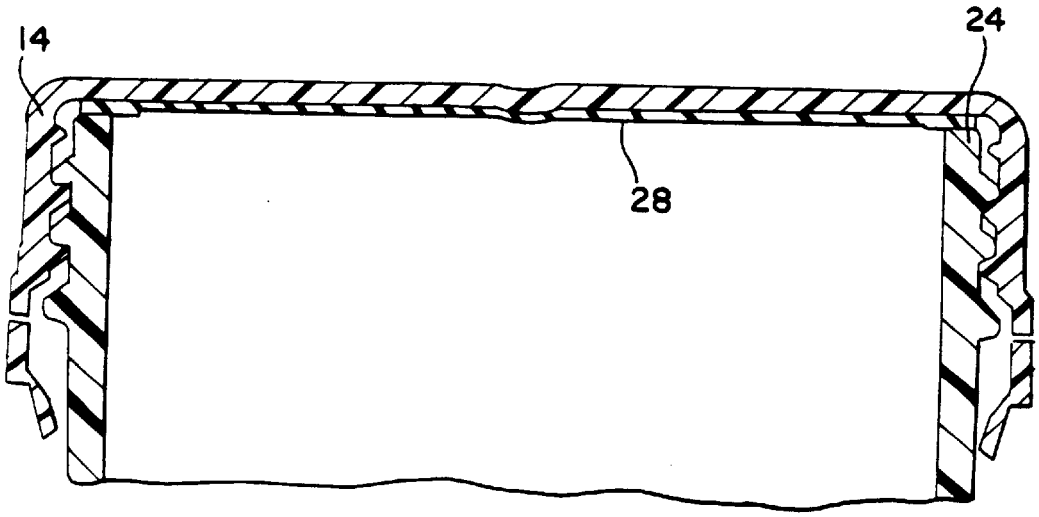
FIG. 2 is a cross-sectional view of a container closure with a liner embodying the present invention adhered to the inner surface of the closure.
Figure 3:
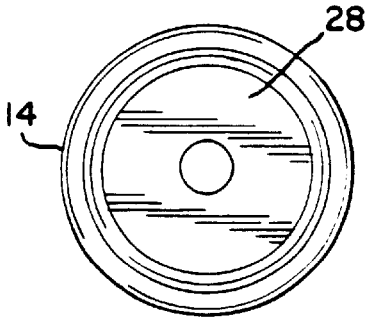
FIG. 3 is a plan view of the inner surface of a closure with the liner of FIG. 2 adhered to the inner-facing surface of the closure.
Figure 4:
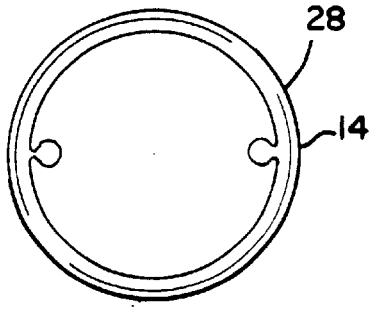
FIG. 4 is a plan view of a closure with another embodiment of the liner adhered to the inner-facing surface of the closure.
Figure 5:
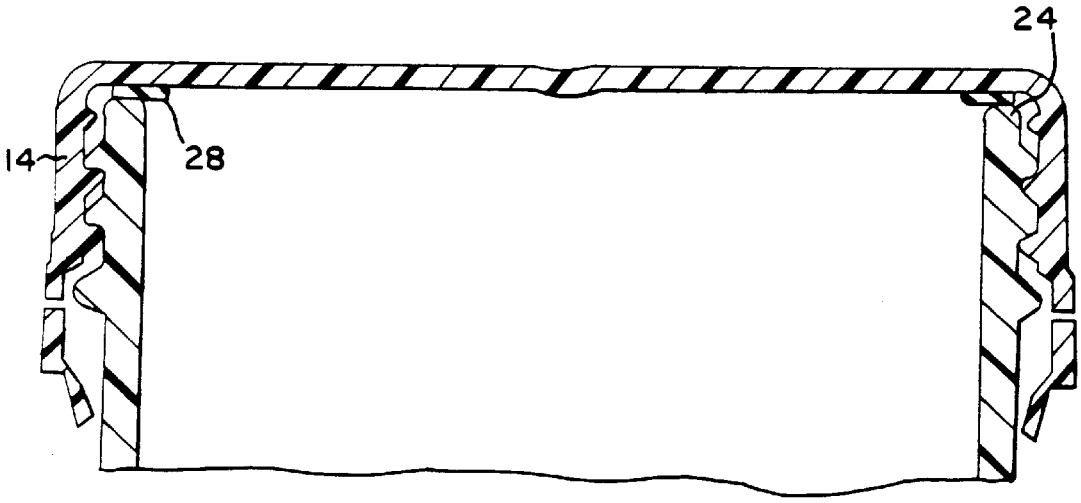
FIG. 5 is a cross-sectional view of the closure of FIG. 1 with the liner of FIG. 4 adhered to the inner surface of the closure end panel.

As best shown in FIG. 2, shell 14 seals the open mouth of container 10 defined by end finish 24. As further shown in FIGS. 2 and 3, closure shell 14 includes a liner 28 adhered to the inner-facing surface of shell 14. Liner 28 can be in the shape of a circular disc that covers substantially the entire inner-facing surface of end panel of shell 14 (FIG. 3). Alternatively, liner 14 can be in the shape of a ring which covers only the annular periphery of the inner-facing surface of the shell (FIG. 4). In any event, liner 28 should contact the end finish of the container walls to provide a hermetic seal between closure shell 14 and the opening and, thereby, limit oxygen ingress from the outside environment into the container interior.

Liners of the type shown in FIGS. 1–5 can be made of a composition comprising a thermoplastic elastomer, polyisobutylene and polybutylene and other additives that, among other things, provides an effective barrier to oxygen, has good torque removal properties, and provides good adhesion to the inner surface of the plastic closure shell 14. The compositions are easy to process by known processing and compounding methods, and moldable into a liner of the type described above.

In one particular embodiment, the plastic composition includes a thermoplastic elastomer, a compound for improving the oxygen barrier properties of the composition and one or more compounds to improve adhesion, torque removal and/or processability. The thermoplastic elastomer selected is preferably substantially odorless and tasteless.

Thermoplastic elastomers are polymers or blends of polymers that can be processed and recycled in the same way as a conventional thermoplastic material, but that also have a rubber-like quality and performance similar to that of rubber. Thermoplastic elastomers can be obtained by combining a thermoplastic polyolefin with an elastomeric composition in a way such that the elastomer is intimately and uniformly dispersed as a particle phase within a continuous phase of the thermoplastic polyolefin.

Examples of thermoplastic elastomers which can be included in the plastic composition of the present invention are, for example, a thermoplastic polyolefin homopolymer or co-polymer blended with an olefinic rubber which is fully cross-linked, partially cross-linked or not cross-linked at all. In a preferred embodiment, the thermoplastic elastomer composition can be a resinous polymer of propylene and a butyl-based cross-linked rubber of the type described in U.S. Pat. No. 5,843,577 to Ouhadi et al., incorporated by reference herein. As further described in U.S. Pat. No. 5,843,577, the thermoplastic elastomer can include other additives, including lubricants such as polyamides and other additives such as, but not limited to, anti-blocking agents. Lubricants are typically added to soften a material and aid in the processing of certain tacky materials. Lubricants can also improve the torque removal properties of a liner made from the composition.

Other examples of suitable thermoplastic elastomers are the thermoplastic elastomers sold by Advanced Elastomer Systems under the product name Trefsin®. In U.S. Pat. No. 6,062,269, Trefsin® is generally described as a thermoplastic resin of the alloyed material of a polypropylene and an isobutylene-isoprene rubber.

In another example, the thermoplastic elastomer composition can include an ethylene-propylene copolymer and rubber which can be cross-linked and/or can include a terpolymer of ethylene, propylene and a diene. Examples of such thermoplastic elastomers include the commercially available Santoprene®. Santoprene® is believed to include an ethylene, propylene and diene terpolymer. Santoprene® and other thermoplastic elastomers like it are available from Advanced Elastomer Systems, L. P. of Akron, Ohio.

The thermoplastic elastomer used in the composition of the present invention can also be a blend of one or more thermoplastic elastomers.

Also useful are thermoplastic elastomeric block copolymers of the saturated A-B-A type based on styrene and butadiene units. For example, styrene-ethylene butylene-styrene (SEBS) type block copolymers can be used. Such co-polymers are sold under the trade name Kraton-G® (e.g., Kraton-G 1652 and Kraton-G 2705) and are available from the Shell Chemical Company.

Although some of the thermoplastic elastomers described above may, to some degree, provide a barrier to oxygen, to further enhance such oxygen barrier properties, other compounds can be added to the plastic composition. For example, butyl rubbers such as polyisobutylene are desirable because they provide good oxygen barrier properties. Accordingly, the thermoplastic elastomer can be combined with an effective amount of polyisobutylene. Polyisobutylene is available from a variety of suppliers including the Exxon Corporation.

The thermoplastic elastomers described above can be combined with other additives to improve adhesion of the liner to the closure shell. Where the shell is made of a thermoplastic polyolefin such as polypropylene, improved adhesion is provided by adding an effective amount of other polyolefin. One such polyolefin is polybutylene, which provides improved adhesion of the plastic composition to the polypropylene shell of a closure. Polybutylene also improves the flow characteristics and overall processability of the plastic composition. An example of a polybutylene that is suitable for inclusion in the plastic composition of the present invention is PB 0400 available from Montell Corporation. Alternatively, or in addition to polybutylene, polypropylene may be added to the thermoplastic elastomer of the composition.

As discussed above, closures for food and beverage containers should also possess good torque removal properties. Accordingly, in addition to the above, a selected amount of a wax material can be added to the plastic composition to improve torque removal. A microcrystalline wax has been found to work particularly well and is preferred. In fact, it has been discovered that addition of a small amount of microcrystalline wax to the plastic composition described above improves the torque removal properties of the closure without significantly affecting the other desirable properties, such as oxygen barrier properties of the composition. Microcrystalline waxes suitable for inclusion in the plastic composition of the present invention can be a highly branched chain hydrocarbon of the aliphatic-alicyclic alkane family. Such waxes are sold under the name Okerin-6080H and are available from Honeywell of Morristown, N.J.

Other additives may also be included to improve the processability of the composition blend. In one embodiment, an anti-blocking talc can be added to the blend. More specifically, the anti-blocking talc can be combined with polyisobutylene to prevent agglomeration of the polyisobutylene during processing.

The above described compounds can be combined in proportions so that the plastic composition, when formed into a liner for the closure, provides excellent oxygen barrier properties, torque removal properties, adhesion to the polymeric shell and is easy to process. Accordingly, in one preferred embodiment, the plastic composition can include between approximately 40–70 parts, by weight, of the thermoplastic elastomer, approximately 15–30 parts, by weight, of the polyisobutylene and approximately 10–35 parts of polybutylene. Additionally, the plastic composition can include 2–10 parts, by weight, of a wax, preferably a microcrystalline wax. The plastic composition can further include less than approximately 3 parts, by weight, of an anti-blocking talc.

The relative proportions described above provide a plastic composition that can be molded into an effective liner for a plastic closure with the properties described above. While adjustments to the above-described proportions are possible, it has been discovered that amounts of the components significantly outside of the ranges described above can result in a liner with certain properties that are inferior to the properties possessed by liners that include the components in the proportions described above. For example, if the amount of polybutylene is significantly below the lower end of the preferred range, the resultant liners may not adhere as well to the inner surface of the closure. If, on the other hand, the amount of polybutylene is significantly greater from the upper limit of the preferred range, the resultant liner may be too hard and, thus, negatively affect sealability of the closure to the container.

Too much polyisobutylene can result in a blend that is too soft and viscous and, as a result, is more difficult to process. A lower amount of polyisobutylene, on the other hand, will reduce the oxygen barrier properties of the liner.

In accordance with the method for making the plastic composition, the above described compounds can be combined as follows. In one embodiment, the selected amount of polyisobutylene is first mixed with an anti-blocking talc in a Banbury-type mixer for approximately 2–4 minutes. The selected amounts of the thermoplastic elastomer, polybutylene, and microcrystalline are then added.

In another embodiment, the thermoplastic elastomer is processed and mixed in, for example, a twin-screw mixer to a temperature not exceeding 225° C. After mixing, the selected amount of polyisobutylene can be compounded with the thermoplastic elastomer followed by addition of the polybutylene. Finally, the microcrystalline wax is added to the blend while continuing to mix the compounds.

Alternatively, the thermoplastic elastomer and the polybutylene can be initially combined and mixed to a temperature not exceeding 225° C. This is followed by adding a selected amount of polyisobutylene and finally the microcrystalline wax. A preferred mixing temperature for preparing the plastic composition, as set forth above, is less than 225° C and, preferably, approximately 180° C. It has been discovered that at temperatures approaching approximately 225° C, some breakdown of material is observed. The compounds described above can be blended together in ways that are known to those of skill in the art.

After compounding, the plastic composition of the present invention can be formed into a liner and combined with the closure shell to provide a closure as shown in FIGS. 1–5. Liners of the present invention can be formed into discs or pads which can then be cold punch molded onto the inner surface of the closure shell. Alternatively, liners in a gasket-type shape can be injection molded and placed onto the inner surface of the closure shell.

Liners of the present invention which have been formed into discs or pads can have a thickness of approximately 0.005–0.1 inches. More typically, the thickness of such liner discs or pads can be approximately 0.012 inches, except that, as seen in FIG. 2, the thickness of the liner can be greater near or along the annular periphery of the liner where it contacts the end finish of the container. For example, in one embodiment the thickness of the liner near or along the annular periphery can be approximately 0.01–0.05 inches and, more preferably, approximately 0.030–0.035 inches. Such added thickness provides added barrier material where oxygen ingress is most likely to occur, namely, between the closure skirt and the container.

Liners of the present invention exhibit good to excellent oxygen barrier properties and are particularly useful liners for food and beverage containers. For example, using an oxygen permeability measuring apparatus, Model Ox-Tran Ten.Fifty, available from MOCON® of Minneapolis, Minn., liners in accordance with the present invention have an oxygen ingress rate of less than approximately 14.0 cc/$m^2$/day at normal atmospheric conditions. Indeed, liners of the present invention typically limit the oxygen ingress rate to between approximately 4–8 cc/$m^2$/day at normal atmospheric conditions. (Briefly, equipment of the type described above measures oxygen ingress by introducing nitrogen gas into a vessel sealed with a liner sample (plaque) or a closure fitted with a liner. The nitrogen gas picks up any oxygen present within the sealed vessel. The nitrogen gas exits the vessel through an outlet and the level of captured oxygen is recorded as an electronic signal and reported as cubic centimeters (cc) of oxygen permeating across a square meter($m^2$) of a plaque or into a package (closure with liner) in a day.)

Further details regarding liners made from the compositions and the advantages provided by the present invention will become apparent from the following illustrative working examples.

EXAMPLE 1

Samples of the plastic composition made in accordance with the present invention were prepared by blending approximately 65 parts of a thermoplastic elastomer that includes a homopolymer or copolymer of polypropylene and a butyl-based rubber, 20 parts polyisobutylene, 15 parts polybutylene and 4 parts microcrystalline wax. The composition was formed into a liner and molded to the inner surface of a polypropylene shell. Oxygen ingress through the closure with the liner was measured using the MOCON® permeation measuring equipment referred to above. Oxygen ingress into the container through a closure having a diameter of approximately 43 mm and including a liner made from the composition described above was measured as approximately 0.0024–0.005 cc/pkg/day/atm.

Closures of different sizes (diameters) were also provided with liners made in accordance with the present invention on the one hand and liners made from a SEBS block copolymer, mineral oil and lubricant on the other hand. As shown in Table 1, when compared to closures having a liner made from a SEBS block copolymer, mineral oil and lubricant (identified as 615), closures with liners made in accordance with the present invention (identified as 622) consistently displayed superior oxygen barrier properties (i.e., less oxygen ingress).

Also, as shown in Table I, oxygen ingress through a plastic bottle (i.e., either a mono-layered PET or multi-layered bottle) with closures of different size having liners of different shapes was also measured. Again, bottles fitted with closures that included liners made in accordance with the present invention (identified as 622) consistently exhibited lower oxygen ingress than bottles fitted with closures having liners made from other plastic compositions.

TABLE I

COMPARISON OF OXYGEN INGRESS THROUGH DIFFERENT LINERS

| | | | MOCON (cc/package/day/atm.) | | | Oxygen Ingress (ppm/1 Year) | |
|---|---|---|---|---|---|---|---|
| Size Closure | Liner Profile | Liner Material | High | Low | Average | Mono-layer PET*** | Multi-layered**** |
| 38 mm | Flat | 615 | | | 0.0150 | 35 | 13 |
| 38 mm | Flat | 622 | 0.0019 | 0.0011 | 0.0015 | 27 | 6 |
| 38 mm | Plug | 622 | 0.0069 | 0.0044 | 0.0058 | 30 | 8 |
| 38 mm | Plug | 615 | 0.0219 | 0.0180 | 0.0193 | 37 | 16 |
| 38 mm | Plug | 622 | 0.0111 | 0.0090 | 0.0104 | 32 | 12 |
| 38 mm | Aseptic | 615 | | | 0.0150 | 35 | 13 |
| 38 mm | Aseptic | 622 | 0.0036 | 0.0032 | 0.0035 | 28 | 7 |
| 43 mm | Flat | 615 | 0.0240 | 0.0160 | 0.018 | 36 | 15 |
| 43 mm | Flat | 622 | 0.0060 | 0.0018 | 0.003–0.005 | 28 | 7 |
| 63 mm | Full Pad | 615 | 0.0520 | 0.0350 | 0.036–0.042 | 46 | 25 |
| 63 mm | Full Pad | 622 | 0.0144 | 0.0107 | 0.0130 | 33 | 12 |
| 63 mm | Ring Lined | 615 | | | 0.0430 | 50 | 29 |
| 63 mm | Ring Lined | 622 | 0.0160 | 0.0130 | 0.0140 | 34 | 13 |
| 82 mm** | Ring Lined | 615 | 0.0452 | 0.0392 | 0.0410 | 49 | 28 |
| 82 mm** | Ring Lined | 622 | 0.0401 | 0.0243 | 0.0319 | 44 | 22 |

**Readings obtained by subtracting the average of PET bottle ingress from bottle/closure combination (No 82 mm glass available).

***Sealed on 32 oz. PET mono-layer bottle with oxygen ingress of 0.048 cc/pkg./day/atm.

****Sealed on 32 oz. Multi-layer bottle with oxygen ingress of 0.009 cc/pkg./day/atm.

EXAMPLE 2

Oxygen ingress through the liner alone (without the closure cap) was also measured. Sample plaques made from the plastic liner composition of Example 1 and measuring approximately 4×4×0.060 inches were prepared and were measured for oxygen ingress using MOCON® permeation measuring equipment. For comparison, sample plaques made from only the thermoplastic elastomer (without polyisobutylene, polybutylene and microcrystalline wax) were prepared and also measured for oxygen ingress. Oxygen ingress across the plaque made from the liner composition of the present invention was approximately 4.8–7.9 cc/m$^2$/day/atm. By comparison, oxygen ingress across the plaque made from the thermoplastic elastomer alone was approximately 14.4 cc/m$^2$/day.

In addition to the above, liners of the present invention exhibit excellent adhesion to the polypropylene shells often used for beverage containers. Liners of the present invention made from the plastic composition also exhibit excellent mechanical and physical strength. For example, liners made from the preferred plastic compositions described above exhibit a 100% modulus of greater than approximately 260 psi. A percent elongation of greater than approximately 350 and a tensile strength of greater than approximately 500 psi.

EXAMPLE 3

Modulus, Elongation and Tensile Strength

Samples of the plastic composition were prepared by blending approximately 65 parts thermoplastic elastomer that includes a homopolymer or copolymer of polypropylene and a butyl-based rubber, 20 parts polyisobutylene, 15 parts polybutylene and 4 parts microcrystalline wax. The blend was extruded into a 0.060×6×6 (inch) plaque from which samples were die cut in accordance with ASTM D412 procedures. The samples were tested for 100% modulus psi percent elongation and tensile strength psi (ASTM D412). Three lots of the composition made in accordance with the present invention were prepared and average values are set forth below in Table II. For comparison, a lot of the thermoplastic elastomer alone (without the polybutylene, polyisobutylene and microcrystalline wax) was similarly tested for 100% modulus psi, elongation and tensile strength psi. The results of such testing are likewise reported in Table II under the heading "TPE." As seen from Table II, the plastic composition of the present invention (identified as 622) was also superior in these mechanical and physical properties.

TABLE II

| | 622 | TPE |
|---|---|---|
| 100% Modulus | 337 | 255 |
| Elongation % | 460 | 332 |
| Tensile psi | 667 | 481 |

The above described closures were also tested for adhesion to the polypropylene shell. In general, liners made in accordance with the present invention exhibited excellent adhesion to the shell.

The present invention has been described in the context of its preferred embodiments. It will be apparent to those skilled in the art, however, that modifications and variations therefrom can be made without departing from the spirit and scope of this invention. Accordingly, this invention is to be construed by the scope of the appended claims.

That which is claimed:

1. A substantially oxygen-impermeant and substantially oil-free closure cap liner or gasket composition comprising a blend of a thermoplastic elastomer, polybutylene and polyisobutylene, wherein said blend comprises, by weight, between approximately 40 to 70 parts of said thermoplastic elastomer, approximately 15 to 30 parts of said polyisobutylene and approximately 10 to 35 parts of said polybutylene.

2. The composition of claim 1 further comprising a microcrystalline wax.

3. The composition of claim 1 wherein said blend comprises, by weight, approximately 65 parts thermoplastic elastomer, approximately 20 parts polyisobutylene and approximately 15 parts polybutylene.

4. The composition of claim 1, wherein said composition exhibits a 100% modulus of greater than approximately 280 psi, a percent elongation of greater than approximately 400 and a tensile strength of greater than approximately 500 psi.

5. The composition of claim 1 wherein said thermoplastic elastomer comprises polypropylene and a butyl-based rubber.

6. The composition of claim 2 wherein said blend comprises, by weight, approximately 65 parts thermoplastic elastomer, approximately 20 parts polyisobutylene, approximately 15 parts polybutylene and approximately 4 parts microcrystalline wax.

7. The composition of claim 2 wherein said microcrystalline wax is a highly branched chain hydrocarbon of the aliphatic-alicyclic alkane family.

8. A substantially oxygen-impermeant and substantially oil-free closure cap liner or gasket composition comprising a blend of a thermoplastic elastomer, polybutylene and polyisobutylene, wherein the oxygen ingress rate, when measured across a 4×4×0.060 inch sample plaque of a liner made from said composition, is less than approximately 14.4 cc/m$^2$/day.

9. The composition of claim 8 wherein the oxygen ingress rate, when measured across a 4×4×0.060 inch sample plaque of a liner made from said composition, is between approximately 4.8–7.9 cc/m$^2$/day.

10. The composition of claim 8 wherein said blend comprises, by weight, between approximately 40–70 parts thermoplastic elastomer, approximately 15 to 30 parts polyisobutylene and approximately 10 to 35 parts polybutylene.

11. The composition of claim 10 wherein said blend comprises, by weight, approximately 65 parts thermoplastic elastomer, approximately 20 parts polyisobutylene, approximately 15 parts polybutylene and approximately 4 parts microcrystalline wax.

12. The composition of claim 10 wherein the oxygen ingress rate, when measured across a 4×4×0.060 inch sample plaque of a liner made from said composition, is between approximately 4.8–7.9 cc/m$^2$/day.

13. The composition of claim 12 wherein said composition has 100% modulus of greater than 260 psi, a percent elongation of greater than approximately 350 and a tensile strength of greater than approximately 500 psi.

* * * * *